United States Patent [19]

Sokol

[11] 4,209,983

[45] Jul. 1, 1980

[54] INTERNAL ELECTRIC EXPLOSION ENGINE

[76] Inventor: Benjamin Sokol, 24 Hiawatha Blvd., Oakland, N.J. 07436

[21] Appl. No.: 23,562

[22] Filed: Mar. 26, 1979

[51] Int. Cl.[2] ..... F15B 1/02; F15B 15/18

[52] U.S. Cl. ..... 60/325; 60/413; 60/634; 60/DIG. 2; 417/73; 60/39.44

[58] Field of Search ..... 60/325, 327, 369, 371, 60/413, 634, DIG. 2, 39.44, 39.6; 417/52, 73, 207, 240; 91/5

[56] References Cited

U.S. PATENT DOCUMENTS

| | | | |
|---|---|---|---|
| 800,684 | 10/1905 | Schneider | 60/39.44 X |
| 3,185,106 | 5/1965 | Smith | 417/73 X |
| 3,188,551 | 6/1965 | Stuetzer | 60/DIG. 2 |

FOREIGN PATENT DOCUMENTS

| | | | |
|---|---|---|---|
| 571128 | 1/1924 | France | 60/39.44 |
| 177705 | 4/1922 | United Kingdom | 60/39.44 |

OTHER PUBLICATIONS

"Popular Science," May 1950 issue, p. 151.

"The American Inventor," vol. 15, No. 4, p. 101, publ at 114–118 Liberty St., New York, N.Y.

*Primary Examiner*—Edgar W. Geoghegan

[57] ABSTRACT

An internal explosion engine, having a vessel with an interior space and inlets and outlets for respectively introducing fluid into said space at relatively low pressure and removing said fluid from said space at relatively high pressure; an electric discharge explosion in situ sparking device having spaced electric discharge elements that are disposed in said space, said discharge sparking device further including an applied electrical potential of opposite polarities to said discharge elements, a fluid reservoir for holding said fluid, and a drive adapted to be driven by the pressurized fluid to do work; wherein said electrical discharge device is adapted to explode in said fluid, said exploded fluid expanding in volume to increase the internal pressure in said system, to provide said pressurized fluid whereby said drive is driven by said increased internal pressure.

3 Claims, 4 Drawing Figures

INTERNAL ELECTRIC EXPLOSION ENGINE

BACKGROUND OF THE INVENTION

The present invention relates to an engine particularly to one having internal in situ electric explosive discharge capability for rapidly moving a fluid and thereby causing the fluid to do work.

There are familiar to the prior art many types of engines for doing work, the most commonly known such engine being the internal combustion engine, which generally provides for the introduction of a combustible material, such as gasoline and air, into a combustion chamber where the combustible material is ignited. The ignited material or fuel burns since it is premixed with air, the resulting combustion forcing the engine piston to move, as a result of which the piston does work.

While internal combustion engines of the above type are very popular, they suffer from a number of disadvantages, which include pollution of the atmosphere by the spent fuel and gases and the necessity for petroleum products to be used as the fuel, such petroleum products being relatively expensive and their supply being sometimes in question.

The present invention seeks to overcome the above drawbacks of the internal combustion engine and to provide other benefits as well.

OBJECTS OF THE INVENTION

The present invention has as an object the provision of an engine capable of doing work without the adverse effects of air pollution and without consuming petroleum products as fuel.

Another object of the invention is the provision of an internal electric explosive discharge engine that employs no combustible fuel and exhausts no spent gases.

A further object is such an engine that uses a relatively inexhaustible material for producing power.

Another object is such an engine that is a self-contained, closed system, wherein only electricity is consumed and work is the output.

DESCRIPTION OF THE PREFERRED EMBODIMENT

Figure 1:
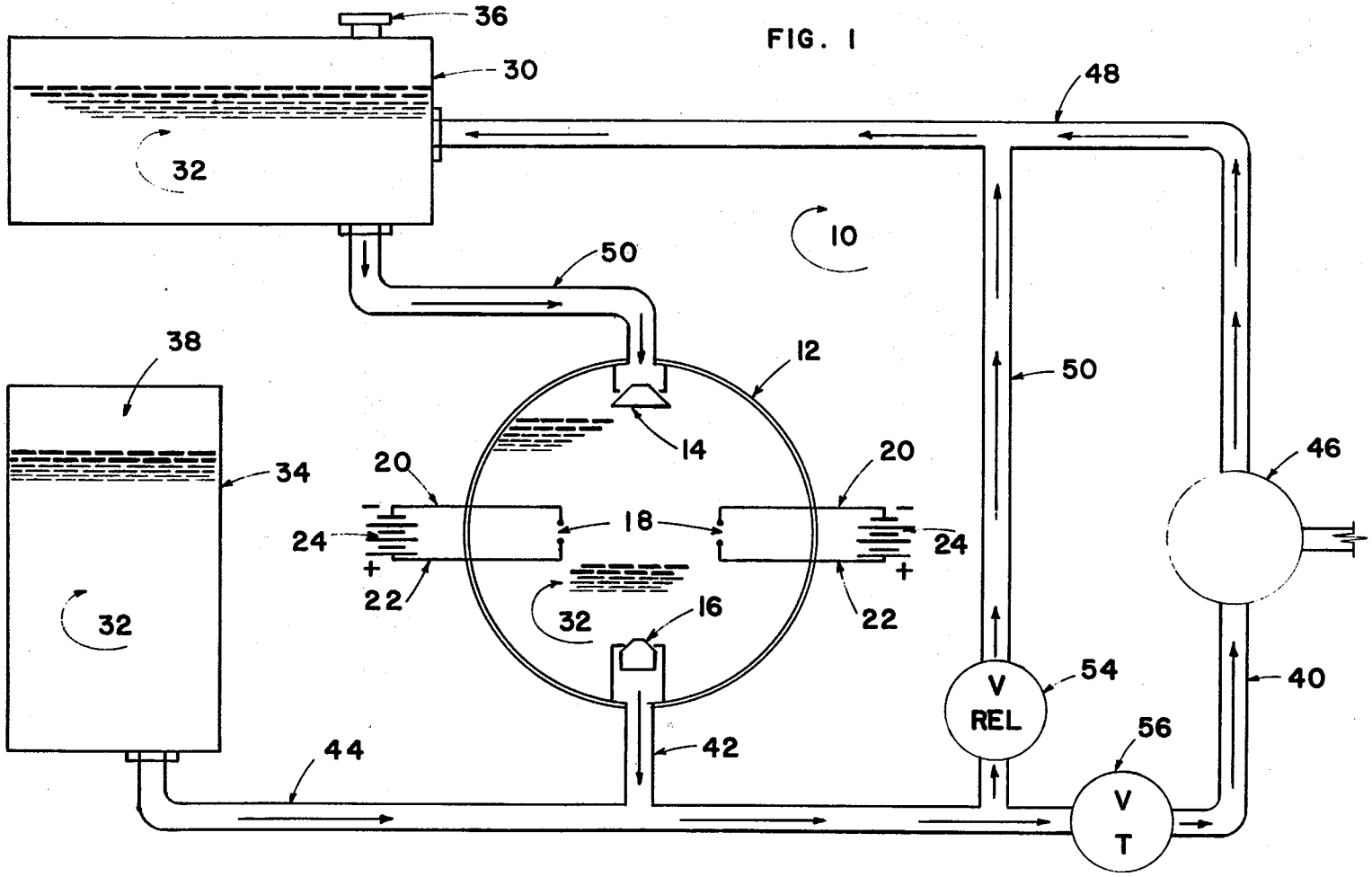
FIG. 1 is a schematic depiction of the internal electric discharge engine system of the present invention, according to a preferred embodiment.

Referring to FIG. 1, the internal electric discharge engine 10 comprises a self-contained closed system that includes an explosion chamber 12 having ingress and egress means, e.g., intake valve 14 and egress valve 16 by which, repectively, a fluid can be introduced into the vessel 12 and ejected therefrom. Also included in the system are electric discharge means 18, that comprise one or more pairs of electric discharge elements 20, 22 and means 24 for applying current to the discharge elements, which can be discharge plates or other forms of electrodes, with electrical potential of opposite polarities. The discharge elements 20, 22 are spaced from each other to form a spark gap between them, as further explained below.

The engine system 10 further includes a reservoir 30 for holding fluid 32 under relatively low pressure (e.g., atmospheric pressure) and a storage tank 34 for holding the fluid under relatively high pressure. The fluid held in the reservoir 30 and storage tank 34 can be and generally is in the liquid state, the system 10 also containing such fluid 32, as explained in greater detail below. It is important to the present invention that there be caused an in situ explosion in the liquid, to create a pressure for doing work with the liquid.

While there are a number of fluids that can be used in the present engine system, it is preferred that the fluid be of a dielectric non-polar material, it being further preferred that the material have a relatively low vapor pressure. Some examples of materials that can be used as the fluid are various silicone fluids, carbon tetrachloride, mineral oil and pure water, or a dense gas with entrainment of a liquid.

The engine system 10 also includes a closed conduit system 40 that has a first conduit element 42 connecting the vessel 12, via outlet valve 16, with a second conduit 44 that leads from the high pressure storage tank 34 to a piston member 46 of the engine system 10. It is to be understood that, as used herein, the term "piston" and "piston member" and "piston means" are intended to include and to be defined to include any mechanical or other device that can be driven by a pressure increase within the closed engine system 10, same including a reciprocating piston, a crankshaft, or a turbine or hydraulic motor, whereby, as explained below, the in situ explosion in the non-combustible fluid 32 causes an increase in the internal pressure of the closed system, resulting in the so-called piston member being moved in response thereto. Where the piston member is, in fact, a piston, that piston will be driven in a certain direction in response to the internal pressure increase resulting from the explosion in the fluid, and return to its previous position when the internal pressure is restored to its previous level. The storage tank 34 will store excess fluid under pressure awaiting further demand. Hence, the explosions in the fluid 32 result in a number of sequential pressure bursts that drive the piston in reciprocating fashion, permitting the piston to provide power for driving an external mechanism and doing work. Where the "piston member" is a crankshaft, the internal pressure increase (i.e., the explosion in the fluid) can do work on a vane or vanes to turn the crankshaft. Hence, it can be seen that the "piston means", which translate the internal pressure increase to mechanical motion, can be of the reciprocating type (e.g., a piston) or of a non-reciprocating type.

A third conduit element 48 connects the piston means 46 with reservoir 30 and the reservoir 30 is connected via a fourth conduit element 50 and inlet valve 14 with the vessel 12.

A fifth conduit element or shunt conduit 52 connects the second conduit 44 and the third conduit element 48, there being a by-pass pressure relief valve 54 located at the juncture of the shunt conduit element and the second conduit element 44. Between the pressure by-pass valve 54 whose function is to prevent too high a pressure build up in the storage tank 32 and the piston means 46, there is, in the second conduit element 44, a control valve 56, which functions as a throttle valve controlling the amount of high pressure fluid volume that acts upon the piston means 46, thereby controlling the work output.

In the operation of the engine 10, the electrodes or discharge elements 20, 22 (of which there can be one or more pairs, two such pairs being shown in FIG. 1) are energized by applying electrical potential to them. Where there are plural pairs of such discharge elements 20, 22, they can be so energized simultaneously or, where desired, sequentially to achieve, in the case of sequential energization, a nearly continuous firing. The applied potential is of high energy, to produce a high energy explosive discharge across the gap between the discharge elements 20, 22.

The resulting high energy spark or sparks between the electrodes or discharge elements 20, 22 expands the fluid, increasing the pressure in explosion chamber 12. At least part of the fluid 32 which is in the explosion chamber 12 is ejected into the storage tank 34 via outlet valve 16 which opens to admit the fluid 32 into first and second conduit elements 42 and 44; outlet valve 16 is otherwise in closed position. While the explosion process occurs, the inlet valve 14 is closed, it being opened when the explosion and ejection is completed, and a negative pressure exists relative to atmospheric pressure. It is to be noted that the high energy sparks expand the fluid 32 in a very short time, such that the pressure in the vessel 12 is raised quickly, obtaining what can be considered to be a pressure burst that can be likened to an explosion caused by igniting a combustible fuel, even though the present invention does not require that a combustible fuel be utilized.

The explosion in the fluid 32 causes the pressure build-up that can be used to do work, as by piston means 46. The electrical discharge across the electrodes or discharge elements 20, 22 produces a large amount of localized heat that can vaporize some of the fluid 32. The electrical discharge may also produce a shock wave, which can be used for doing work. It may, in some instances, be desirable to provide the engine 10 with cooling fins or other means of cooling the working fluid and the engine.

The electrical potential applied to the discharge elements can be of square wave, half-wave, sinusoidal wave, saw-tooth wave, or other configuration. Where a saw-tooth wave is used, it is desirable in some instances that the level taper off so that there is a gradual decay in the pressure build up after a relatively fast increase in pressure.

The ejected fluid 32 passes out of the vessel 12 via outlet valve 16 and is stored in the high pressure storage tank 34 until the throttle valve 56 is opened and high pressure fluid is applied to the piston means to do work. The discharge from the hydraulic motor 46 returns to the reservoir 30 to await repeat of the cycle. Tank 34 has a vented cap 36.

In the embodiment shown in FIG. 1, the high pressure storage tank 34 can receive any high pressure fluid, the tank 34 having a trapped air space above the fluid 32 contained therein so that the air can be compressed by the pressure burst caused by the fluid pressure buildup. This provides the benefit of dampening the repeated explosions and retaining the fluid under pressure.

The engine system of the present invention, can, according to another embodiment comprise two or more explosion vessels such as that shown in FIG. 1, the size and number of such vessels being determined by the amount of power desired. While it is desired to build a large volume of work capacity, the vessels can be connected, via suitable conduits, in parallel, while a high level of force can be achieved by connecting the vessels in series, as explained below.

In general, it is preferred though not necessary, that the electrical potential applied to the discharge elements 20, 22 result from the discharge of a capacitor or capacitor bank, or a transformer, so as to achieve a high energy discharge.

The operation of the explosion chamber 12 may be likened to that of a pump and may in fact be used as such to move a fluid or to raise its pressure for any needed purpose.

According to another preferred embodiment of the invention, the internal electric explosion engine 60 (FIGS. 2 and 3) comprises a stator member 62 and a rotor member 64, the engine apparatus 60 including, also, a housing 66 defining a fluid reservoir in which the fluid 68 is contained. A drive shaft 70 is connected to the rotor member 64 and extends, according to one form of the invention, through the lower and upper walls 74, 72 respectively of the housing 66, which can include a vent cap 76.

A third wall 78 of the apparatus housing is disposed at the side of the rotor member 64 remote from the fluid reservoir which third wall 78 comprises at least one, and, preferably, plural electric discharge elements 80 generally similar to those described with respect to FIG. 1. These discharge elements 80 are located in openings in the third wall 78 and in pass-throughs 84, so as to prevent the leakage of the fluid, as explained below.

The rotor member 64 comprises a number of peripherally disposed vanes 86 and there are disposed between the second and third wall elements 74, 78 plural explosion chambers 88 at which the discharge elements 80 are located, it being preferred that such discharge elements 80 be associated with respective explosion chambers 88, one (or even more) such discharge element 80 being located at each such chamber 88. According to this form of the invention (while not necessarily limited to this), the explosion chamber 88 is defined, more or less, by the stator member 62, rotor member 64, and the second and third housing walls 74, 78, respectively.

The second wall element 74 has therein one or more ports 90 that extend therethrough to permit the explosion chambers 88 to communicate with the fluid reservoir such that fluid can be introduced from the fluid reservoir into the explosion chambers 88.

In the operation of this apparatus 60, the explosion initiated by the electrical discharge across the discharge elements 80, in one or more of the explosion chambers 88 drives the vanes 86 of the rotor member 64, turning the rotor 64 and the drive shaft 70, thereby permitting work to be done. As the rotor member 64 accelerates, the fluid in the rotor vanes is forced by centrifugal force into the explosion chambers 88, where subsequent explosions (caused by electric discharge) continue the rotation of the rotor 64.

Where it is desired, multiple rotor members similar to rotor member 64 may be mounted on the drive shaft 70 to increase the output torque.

A balance is established at any given rotational speed, between the fluid in the explosion chamber and the reservoir, by way of the fluid access ports 90.

Where desired, the apparatus 60 can be provided with cooling fins or other type of radiator to cool the fluid. Also the present engine apparatus 60 can be operated in any attitude, including vertical or horizontal.

Figure 2:
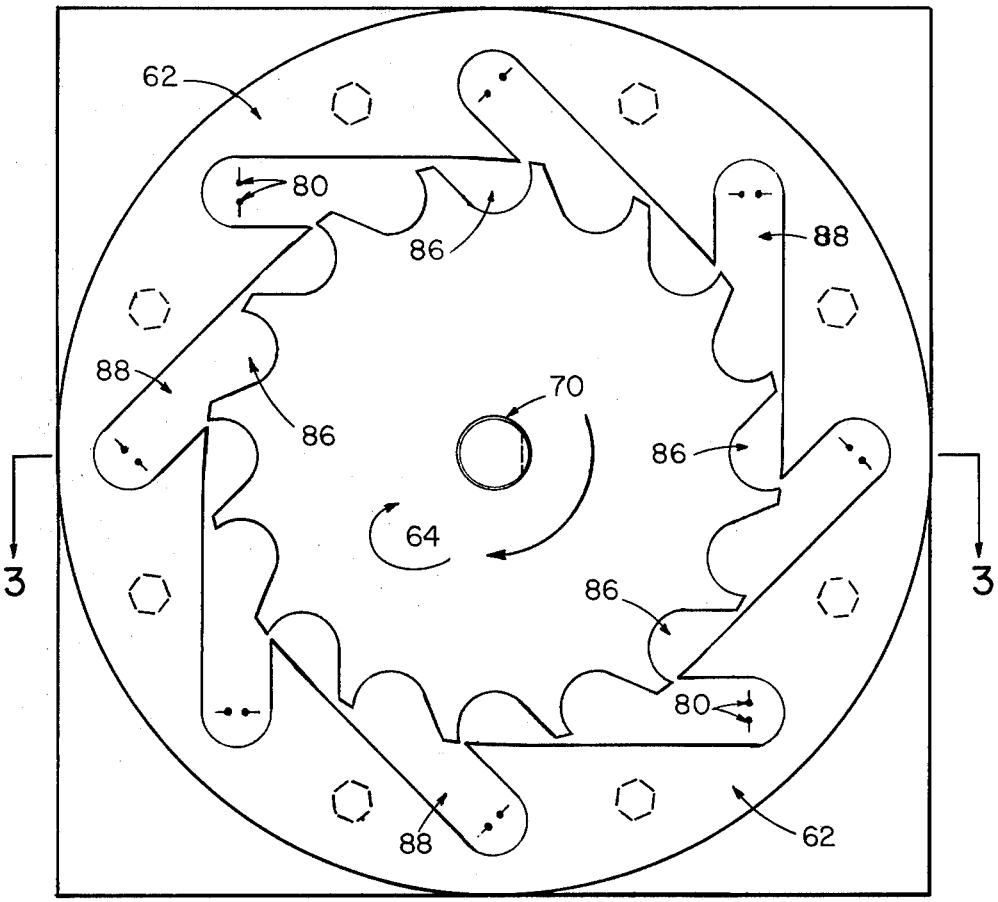
FIG. 2 is a top view of an aternative configuration generally depicting a turbine-like apparatus and utilizing a multiplicity of explosion chambers.
Figure 3:
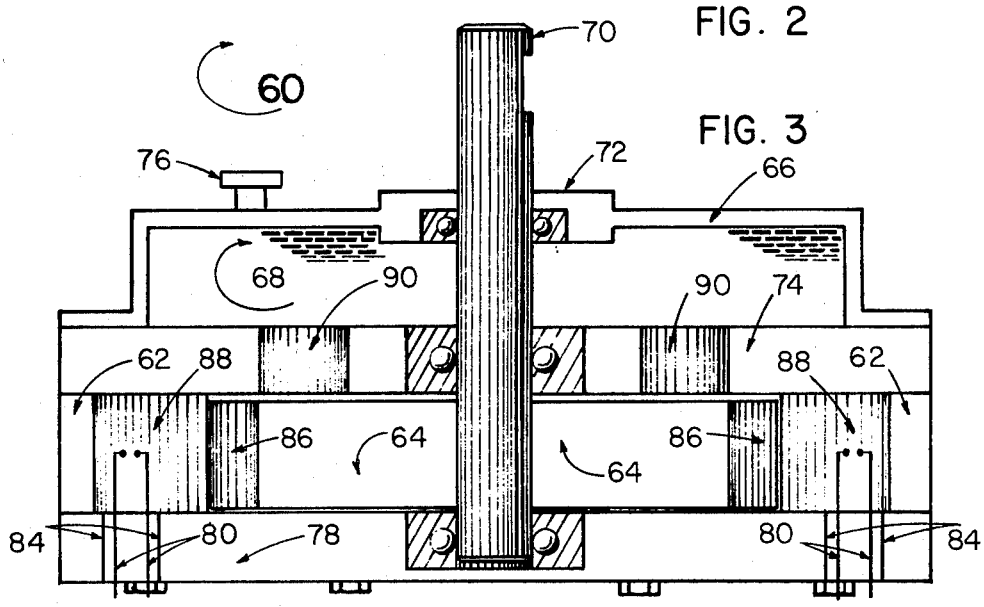
FIG. 3 is a sectional elevation view of the apparatus of FIG. 2, along axis 3—3.

It is generally preferred that the fluid used with the present invention, particularly the embodiment shown in FIGS. 2 and 3, be relatively electrically non-conducting and have some degree of lubricity, some examples of satisfactiry fluids being light silicone fluids, mineral oil, light halogenated hydrocarbons, or water or a dense vapor. While the fluid is not consumed or burned, it may be necessary or desirable to filter or change, from time to time, the fluid of the engine, since the fluid might change as to its molecular makeup or otherwise become deteriorated. The fluid can be non-combustible, it being preferred that it be a non-polar material.

The term "explosion" as used herein is defined to be, generally, the shock and rapid pressure rise effect of the electric discharge on the fluid, and not a combustion of the fluid.

Figure 4:
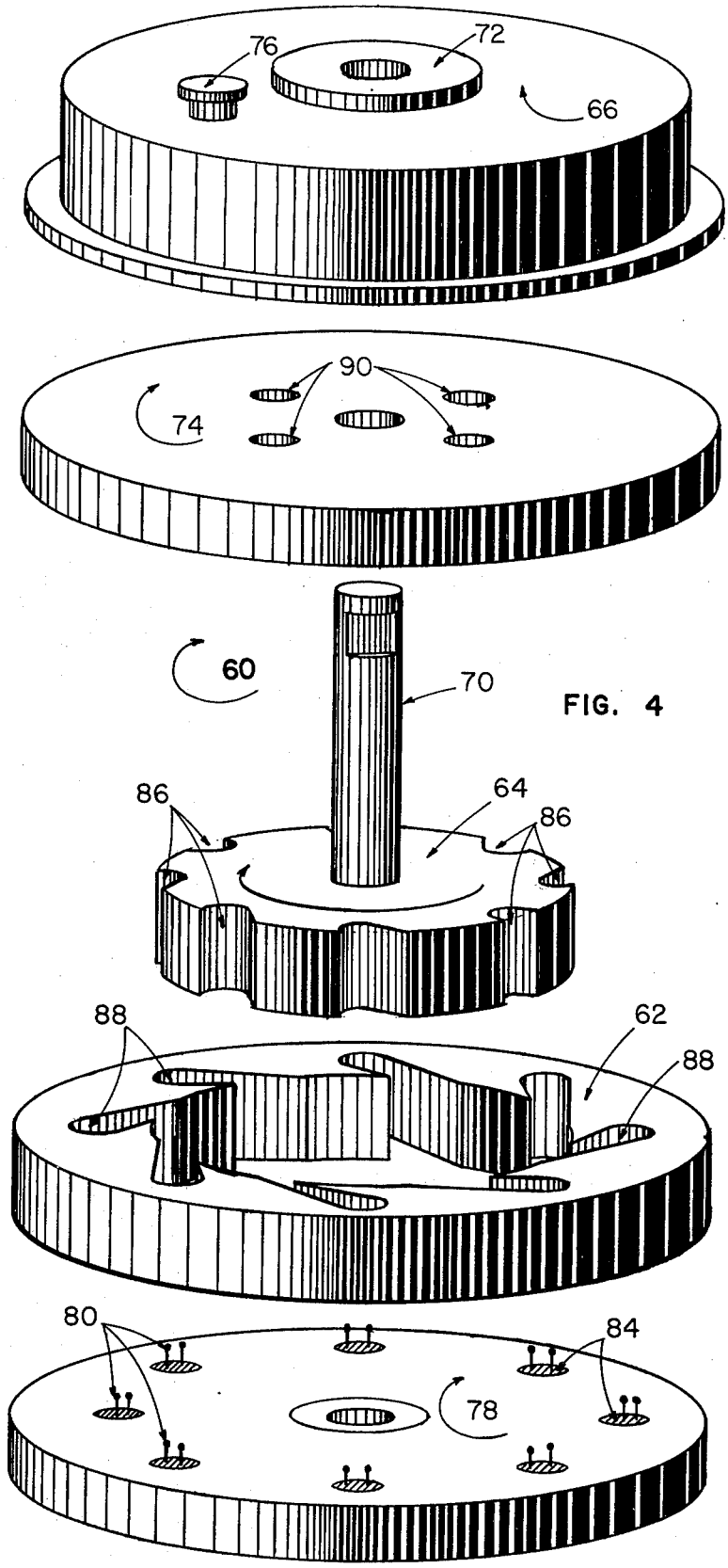
FIG. 4 is an exploded view of FIG. 3.

FIG. 4 is an exploded view of the embodiment of FIG. 3.

I claim:

1. An internal electric explosion engine, comprising;

a vessel having a plurality of interior spaces with inlet and outlet means for respectively introducing a fluid into said spaces at relatively low pressure and removing said fluid from said spaces at relatively high pressure, said spaces serving as explosion chambers;

electric discharge explosion in situ means comprising spaced electric discharge elements disposed in each of said explosion chambers, said discharge means further including means for applying electrical potential of opposite polarities to said discharge elements;

a fluid;

storage means for holding said fluid under pressure;

conduit means for circulating said fluid between said vessel and said storage means;

drive means adapted to be driven by said pressurized fluid so as to do work;

said vessel, said explosion means, said storage means and said conduit means forming a closed loop fluidic pressure system;

wherein said discharge means is adapted to explode in said fluid within said vessel said exploded fluid expanding in volume to increase the internal pressure in said system providing said pressurized fluid whereby said drive means is driven.

2. An engine as defined in claim 1, wherein said drive means comprises at least one rotor member, a drive shaft element connected to said rotor member, said rotor member having plural vane elements communicating with said explosion chambers, said vane elements driven by the pressurized fluid produced by said electrical discharge, and a stator member.

3. An engine as defined in claim 1, wherein said storage means comprises a housing holding said fluid, said housing comprising at least one fluid conduit means whereby said storage means can communicate with said explosion chambers.

* * * * *